US011819869B2

(12) United States Patent
Gold et al.

(10) Patent No.: US 11,819,869 B2
(45) Date of Patent: Nov. 21, 2023

(54) CARRIER LIQUID COMPOSITION CONTROL FOR SUSPENSION PLASMA SPRAYING

(71) Applicants: Rolls-Royce North American Technologies, Inc., Indianapolis, IN (US); Rolls-Royce plc, London (GB)

(72) Inventors: Matthew R. Gold, Carmel, IN (US); James Gyaneshwara Jung Brewster, Hucknall (GB)

(73) Assignees: Rolls-Royce North American Technologies, Inc., Indianapolis, IN (US); Rolls-Royce plc, London (GB)

( * ) Notice: Subject to any disclaimer, the term of this patent is extended or adjusted under 35 U.S.C. 154(b) by 492 days.

(21) Appl. No.: 16/902,978

(22) Filed: Jun. 16, 2020

(65) Prior Publication Data

US 2021/0387216 A1 Dec. 16, 2021

(51) Int. Cl.
*C23C 4/134* (2016.01)
*C23C 4/04* (2006.01)
(Continued)

(52) U.S. Cl.
CPC ..... *B05B 7/26* (2013.01); *B05B 7/1436* (2013.01); *B05D 1/10* (2013.01); *C23C 4/134* (2016.01);
(Continued)

(58) Field of Classification Search
CPC ..... C23C 4/04; C23C 4/129; C23C 4/134; B05D 1/08; B05D 1/10; B05D 2401/20; B05D 2401/21
(Continued)

(56) References Cited

U.S. PATENT DOCUMENTS

2006/0222777 A1* 10/2006 Skoog ..... C23C 4/12 427/446
2013/0230659 A1 9/2013 Quick et al.
2018/0251881 A1* 9/2018 Hazel ..... F23R 3/007

FOREIGN PATENT DOCUMENTS

EP 2453036 A1 5/2012
EP 3101152 A1 * 12/2016 ..... C04B 35/486
WO 2014/007901 A2 1/2014

OTHER PUBLICATIONS

Bernard et al., "Thermal insulation properties of YSZ coatings: Suspension Plasma Spraying (SPS) versus Electron Beam Physical Vapor Deposition (EB-PVD) and Atmospheric Plasma Spraying (APS)," Surface and Coatings Technology, No. 318, Jun. 5, 2016, pp. 122-128.

(Continued)

*Primary Examiner* — William P Fletcher, III
(74) *Attorney, Agent, or Firm* — Shumaker & Sieffert, P.A.

(57) ABSTRACT

In some examples, a method comprising: controlling a first ratio of a first liquid to a second liquid to form a first suspension comprising a powder and a first carrier liquid composition comprising at least one of the first liquid or the second liquid; directing the first suspension comprising the first carrier liquid and the powder to a plume of a thermal spray device; forming a first portion of a coating comprising the powder on a substrate from the first suspension; controlling a second ratio of the first liquid to the second liquid to form a second suspension comprising a second carrier liquid composition and the powder; directing the second suspension comprising the second carrier liquid composition and the powder to the plume of the thermal spray device; and forming a second portion of the coating comprising the powder on the substrate from the second suspension.

20 Claims, 5 Drawing Sheets

(51) Int. Cl.

| | |
|---|---|
| ***B05D 1/10*** | (2006.01) |
| ***B05B 7/26*** | (2006.01) |
| ***B05B 7/14*** | (2006.01) |
| *B05B 7/16* | (2006.01) |

(52) U.S. Cl.
CPC ..... *B05B 7/16* (2013.01); *B05D 2401/20* (2013.01); *C23C 4/04* (2013.01)

(58) Field of Classification Search
USPC ..... 427/444, 453–456
See application file for complete search history.

(56) References Cited

OTHER PUBLICATIONS

Lima et al., "Microstructural Characterization and Room-Temperature Erosion Behavior of As-Deposited SPS, EB-PVD and APS YSZ-Based TBCs," Journal of Thermal Spray Technology, Oct. 4, 2018, vol. 28, pp. 223-232.

* cited by examiner

CARRIER LIQUID COMPOSITION CONTROL FOR SUSPENSION PLASMA SPRAYING

TECHNICAL FIELD

The disclosure relates to techniques for forming coatings using suspension plasma spraying.

BACKGROUND

Coatings are widely used in various industries to modify surface properties of components. Coatings may be applied using various technologies, including vapor phase processes (e.g., chemical vapor deposition, physical vapor deposition, and the like), spraying processes (e.g., thermal spraying, cold spraying, and the like), and slurry deposition processes, among other techniques. Different coating technologies are used with different coating chemistries, and may produce coatings with different properties, e.g., microstructures.

SUMMARY

In some examples, the disclosure describes a method that includes controlling a first ratio of a first liquid to a second liquid to form a first suspension comprising a powder and a first carrier liquid composition comprising at least one of the first liquid or the second liquid; directing the first suspension comprising the first carrier liquid and the powder to a plume of a thermal spray device; forming a first portion of a coating comprising the powder on a substrate from the first suspension; controlling a second ratio of the first liquid to the second liquid to form a second suspension comprising a second carrier liquid composition and the powder; directing the second suspension comprising the second carrier liquid composition and the powder to the plume of the thermal spray device; and forming a second portion of the coating comprising the powder on the substrate from the second suspension.

In some examples, the disclosure describes a system that includes a suspension delivery assembly; a thermal spray device; and a computing device. The computing device may be configured to: control the suspension delivery assembly to deliver a first suspension comprising a first carrier liquid composition and a powder to the thermal spray device, wherein the first carrier liquid composition comprises a first ratio of a first liquid to a second liquid, wherein the thermal spray device delivers the first suspension to a substrate to form a first portion of a coating comprising the powder on the substrate; and control the suspension delivery assembly to deliver a second suspension comprising a second carrier liquid composition and the powder to the thermal spray device, wherein the second carrier liquid composition comprises a second ratio of the first liquid to the second liquid, wherein the thermal spray device delivers the second suspension to the substrate to form a second portion of the coating comprising the powder on the substrate.

In some examples, the disclosure describes a computer readable storage medium comprising instructions, that, when executed by a computing device, cause the computing device to: control a suspension delivery assembly to deliver a first suspension comprising a first carrier liquid composition and a powder to a thermal spray device, wherein the first carrier liquid composition comprises a first ratio of a first liquid to a second liquid, wherein the thermal spray device delivers the first suspension to a substrate to form a first portion of a coating comprising the powder on the substrate; and control the suspension delivery assembly to deliver a second suspension comprising a second carrier liquid composition and the powder to the thermal spray device, wherein the second carrier liquid composition comprises a second ratio of the first liquid to the second liquid, wherein the thermal spray device delivers the second suspension to the substrate to form a second portion of the coating comprising the powder on the substrate.

The details of one or more examples are set forth in the accompanying drawings and the description below. Other features, objects, and advantages will be apparent from the description and drawings, and from the claims.

DETAILED DESCRIPTION

Figure 1:
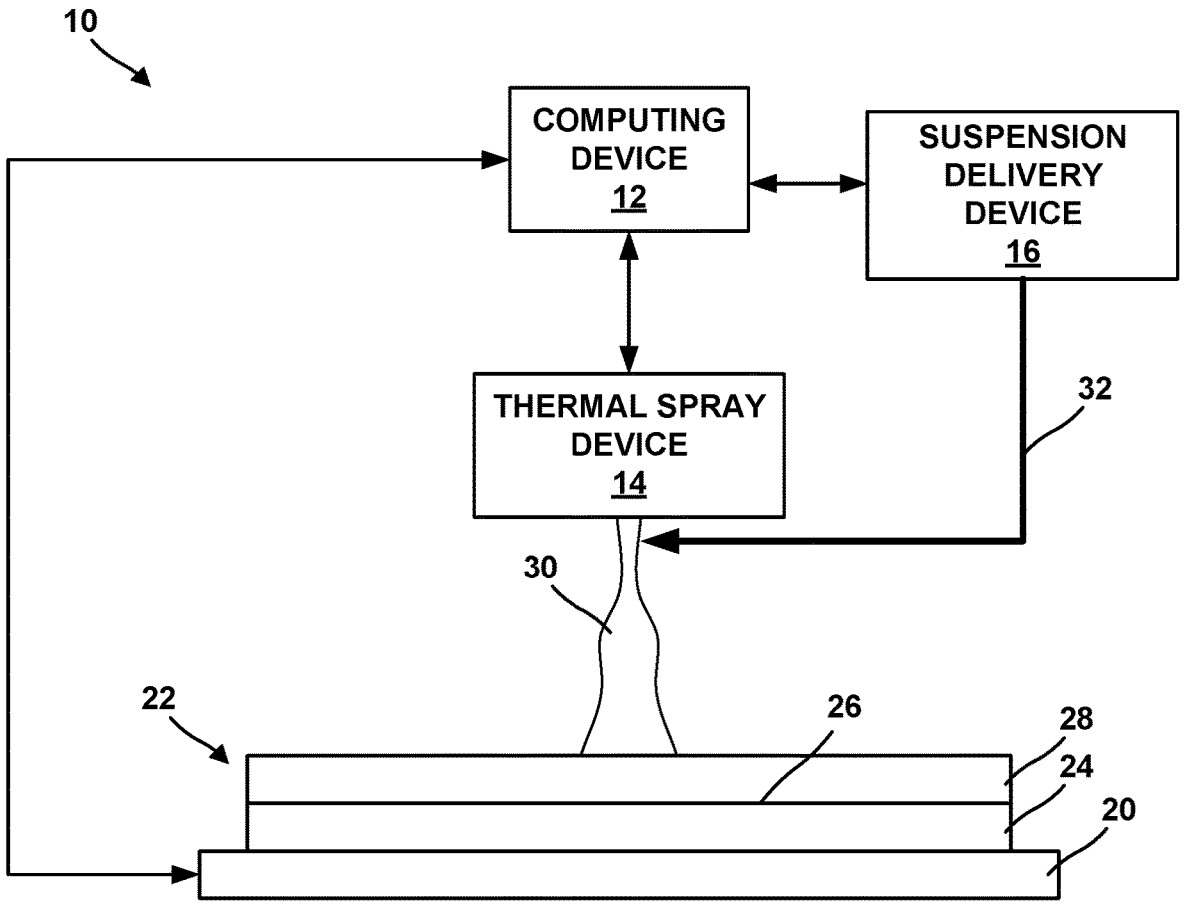
FIG. 1 is a conceptual and schematic diagram illustrating an example system for forming a coating using suspension plasma spraying, in accordance with an example of the disclosure.

In general, the disclosure describes systems and techniques for depositing coatings using suspension plasma spraying. In suspension plasma spraying, relatively fine particles are suspended in a liquid carrier to form a suspension. The suspension is directed to a plume of a thermal spray device (such as a plasma spray gun), which directs the suspension, including the particles, toward a surface of a substrate that is to be coated.

As the suspension is entrained in the plume, the suspension fragments into droplets that include liquid carrier and particles. The droplets impact the surface and the particles adhere to the surface to form a coating.

In accordance with techniques described herein, the composition of the liquid carrier in the suspension may be controlled to affect resulting microstructure of the coating. For example, the composition of the liquid carrier may be controlled to include a first liquid carrier, a second liquid carrier, or a mixture of the first liquid carrier and the second liquid carrier.

The first and second liquid carriers may be selected to have different surface tension. For example, the first liquid carrier may have a lower surface tension than the second liquid carrier. Surface tension of the liquid carrier in the suspension may affect how the suspension fragments into droplets when impinging on the viscous plume. For example, when the liquid carrier has a higher surface tension, the suspension may fragment into relatively larger droplets than when the liquid carrier has a lower surface tension. In this way, by controlling the relative concentration of the first and second liquid carriers in the suspension, the size of droplets into which the suspension fragments may be affected.

The size of droplets into which the suspension fragments may affect the microstructure of the deposited coating. For example, a suspension with lower surface tension, which breaks into relatively smaller droplets, may form a coating having a columnar microstructure. While not wishing to be bound by theory, it is currently believed that this occurs because the relatively smaller droplets are carried across the surface of the substrate on which the coating is being formed to a greater extent than relatively larger droplets. As the relatively smaller droplets are carried across the surface, they may impact surface asperities (e.g., high points on the surface due to surface roughness) and the particles may adhere to the surface. This begins formation of a column, on which subsequent droplets may impact and deposit further material (particles) on the nascent column, eventually forming a column. A similar process may occur across the surface of the substrate to result in a columnar coating.

In contrast, a suspension with higher surface tension, which breaks into relatively larger droplets, may form a coating having a substantially dense microstructure. While not wishing to be bound by theory, it is currently believed that this occurs because the relatively larger droplets are not as easily carried across the surface of the substrate on which the coating is being formed as the relatively smaller droplets. As a result, the relatively larger droplets impact the substrate more directly (e.g., at the angle of the plume with respect to the substrate) and the particles adhere to the substrate upon impact. A similar process may occur across the surface of the substrate as the thermal spray device is translated across the surface to result in a substantially dense coating.

A suspension with an intermediate surface tension (e.g., between the lower surface tension and the higher surface tension) may fracture into intermediately sized droplets, and may be used to deposit a coating with intermediate porosity. As such, by controlling relative amounts of two liquid carriers in a suspension, the resulting coating microstructure may be controlled along a continuum between being substantially dense (e.g., if the suspension includes substantially only the liquid carrier with the higher surface tension) and being columnar (e.g., if the suspension includes substantially only the liquid carrier with the lower surface tension). As the composition of the liquid carrier in the suspension may be controlled substantially in real-time, changes between coating microstructure may be made relatively easily, without switching between batches of different suspensions. This may enable formation of coatings with density (or porosity) gradients, which may allow tailoring of coating properties, e.g., between lower modulus (higher porosity) and hermeticity (lower porosity). The density gradient may be formed in the direction substantially normal to the substrate surface or in the direction parallel to the coating surface.

FIG. 1 is a conceptual and schematic diagram illustrating an example system 10 for forming a coating using suspension plasma spraying, in accordance with an example of the disclosure. System 10 includes a computing device 12, a plasma spray device 14, and suspension delivery device 16, an enclosure 18, and a stage 20.

Computing device 12 may include, for example, a desktop computer, a laptop computer, a workstation, a server, a mainframe, a cloud computing system, or the like. Computing device 12 is configured to control operation of additive manufacturing system 10, including, for example, a plasma spray device 14, and suspension delivery device 16, stage 20, or both. Computing device 12 may be communicatively coupled to a plasma spray device 14, and suspension delivery device 16, stage 20, or both using respective communication connections. In some examples, the communication connections may include network links, such as Ethernet, ATM, or other network connections. Such connections may be wireless and/or wired connections. In other examples, the communication connections may include other types of device connections, such as USB, IEEE 1394, or the like. In some examples, computing device 12 may include control circuitry, such as one or more processors, including one or more microprocessors, digital signal processors (DSPs), application specific integrated circuits (ASICs), field programmable gate arrays (FPGAs), or any other equivalent integrated or discrete logic circuitry, as well as any combinations of such components. The term "processor" or "processing circuitry" may generally refer to any of the foregoing logic circuitry, alone or in combination with other logic circuitry, or any other equivalent circuitry. A control unit including hardware may also perform one or more of the techniques of this disclosure.

Thermal spray device 14 may include any suitable device for carrying out a thermal spraying process. For example, thermal spray device 14 may include a plasma spray gun, which may include two concentric electrodes with a passage between the two electrodes. An DC electrical arc between the electrodes may ignite a plasma formed by a fluid flowing through the passage. Alternatively, the plasma spray gun may include a coil that surrounds a passage. A radio frequency signal may be passed through the coil to inductively transfer energy to the fluid and form the plasma. In either case, the plasma exits the plasma spray gun through an opening or nozzle and is directed to a substrate. As another example, the thermal spray device 14 may include a detonation spaying device, a high-velocity oxygen fuel device, a high velocity air fuel device.

In any case, thermal spray device 14 generates a plume 30, which exits the thermal spray device 14 (e.g., through a nozzle) and is directed toward substrate 24. Depending on the thermal spray process used, plume 30 may be in the form of a plasma plume, a hot gas plume (e.g., in high velocity oxygen fuel spraying or high velocity air fuel spraying), or the like.

Suspension delivery device 16 may include a device or apparatus configured to form and/or deliver a suspension of particles 32 in a liquid carrier to plume 30 (either internal to thermal spray device 14 or external to thermal spray device 14). The suspension may include relatively fine particles of a coating material suspended in a liquid carrier. Suspension delivery device 16 may be configured to control the composition of the liquid carrier in the suspension. For example, suspension delivery device 16 may be configured to control the composition of the liquid carrier to include a first liquid carrier, a second liquid carrier, or a mixture of the first liquid carrier and the second liquid carrier.

The first and second liquid carriers may be selected to have different surface tensions. For example, the first liquid carrier may have a lower surface tension than the second liquid carrier. Surface tension of the liquid carrier in the suspension may affect how the suspension fragments into droplets when impinging on plume 30. For example, when the liquid carrier has a higher surface tension, the suspension may fragment into relatively larger droplets than when the liquid carrier has a lower surface tension. In this way, by controlling the relative concentration of the first and second liquid carriers in the suspension, the size of droplets into which the suspension fragments upon impinging on plume 30 may be affected.

Plume 30 directs suspension 32 toward substrate 24, which in some examples, may be positioned on a stage 20. Stage 20 may include a platform, mount, or other retaining device configured to hold and substantially retain substrate 24 relative to stage 20. In some examples, stage 20 may be configured to move (e.g., rotate and/or translate). In other examples, stage 20 may be configured to be substantially stationary (e.g., relative to enclosure 18).

Substrate 24 may include any component that defines a surface 26 on which a coating 28 is to be formed. In some implementations, substrate 24 may be a component of a high temperature mechanical system, such as a gas turbine engine. In some examples, substrate 24 may include a superalloy. Suitable superalloys include alloys based on Ni, Co, Ni/Fe, and the like. The superalloy may include other additive elements to alter its mechanical properties, such as toughness, hardness, temperature stability, corrosion resistance, oxidation resistance, and the like, as is well known in the art. Any useful superalloy may be used, including, for example, those available from Martin-Marietta Corp., Bethesda, Md., under the trade designation MAR-M247; those available from Cannon-Muskegon Corp., Muskegon, Mich., under the trade designations CMSX-4 and CMSX-10; and the like.

In other examples, substrate 24 may include a ceramic or a ceramic matrix composite (CMC). The CMC may include a ceramic matrix material and a reinforcement material. The ceramic matrix material may include, for example, silicon carbide, silicon nitride, alumina, silica, and the like. The reinforcement material may include a continuous reinforcement or a discontinuous reinforcement. For example, the reinforcement material may include discontinuous whiskers, platelets, or particulates. As another example, the reinforcement material may include a continuous monofilament or multifilament weave.

The reinforcement material composition, shape, size, and the like may be selected to provide the desired properties to the CMC. For example, in some implementations, the reinforcement material may be chosen to increase the toughness of a brittle ceramic matrix. In other embodiments, the reinforcement material may be chosen to provide a desired property to the CMC, such as thermal conductivity, electrical conductivity, thermal expansion, hardness, or the like.

In some examples, the reinforcement material composition may be the same as the ceramic matrix material. For example, a silicon carbide matrix may surround silicon carbide whiskers. In other examples, the filler material may include a different composition than the ceramic matrix, such as mullite fibers in an alumina matrix, or the like. One preferred CMC includes silicon carbide continuous fibers embedded in a silicon carbide matrix.

Coating 28 may include, for example, a thermal barrier coating (TBC), an environmental barrier coating (EBC), an abradable coating, or the like. In some examples, coating 28 includes multiple portions, including layers, adjacent portions along surface 26 of substrate 24, or both.

In some examples, coating 28 may include an optional bond coat. The optional bond coat may be formulated to exhibit desired chemical or physical attraction between substrate 24 and any subsequent layer applied to the bond coat. In some examples in which substrate 24 includes a CMC, the bond coat may include silicon metal, alone, or mixed with at least one other constituent including, for example, at least one of a transition metal carbide, a transition metal boride, or a transition metal nitride. Representative transition metals include, for example, Cr, Mo, Nb, W, Ti, Ta, Hf, or Zr. In some examples, the bond coat may additionally or alternatively include mullite (aluminum silicate, $Al_6Si_2O_{13}$), silica, a silicide, or the like, alone, or in any combination (including in combination with one or more of silicon metal, a transition metal carbide, a transition metal boride, or a transition metal nitride). In examples in which substrate 24 includes a superalloy, the optional bond coat may include any useful alloy, such as a MCrAlY alloy (where M is Ni, Co, or NiCo), a β-NiAl nickel aluminide alloy, a γ-Ni+γ'-$Ni_3Al$ nickel aluminide alloy (either unmodified or modified by Pt, Cr, Hf, Zr, Y, Si, and combinations thereof), or the like.

In some examples, coating 28 may include an EBC, which may provide environmental protection, thermal protection, and/or calcia-magnesia-aluminosilicate (CMAS)-resistance to substrate 24. An EBC may include materials that are resistant to oxidation or water vapor attack, and/or provide at least one of water vapor stability, chemical stability and environmental durability to substrate 24. In some examples, the EBC may be used to protect substrate 24 against oxidation and/or corrosive attacks at high operating temperatures. An EBC coating may include at least one rare earth silicate. The at least one rare earth silicate may include at least one rare earth monosilicate ($RE_2SiO_5$, where RE is a rare earth element), at least one rare earth disilicate ($RE_2Si_2O_7$, where RE is a rare earth element), or combinations thereof. The rare earth element may include at least one of Lu (lutetium), Yb (ytterbium), Tm (thulium), Er (erbium), Ho (holmium), Dy (dysprosium), Tb (terbium), Gd (gadolinium), Eu (europium), Sm (samarium), Pm (promethium), Nd (neodymium), Pr (praseodymium), Ce (cerium), La (lanthanum), Y (yttrium), or Sc (scandium). In some examples, the at least one rare earth element is Yb.

In some examples, in addition to the at least one rare earth silicate, the EBC may include at least one of a free rare earth oxide, an aluminosilicate, or an alkaline earth aluminosilicate. For example, an EBC coating may include mullite, barium strontium aluminosilicate (BSAS), barium aluminosilicate (BAS), strontium aluminosilicate (SAS), at least one free rare earth oxide, or combinations thereof. In some examples, the EBC may include an additive in addition to the primary constituents of the EBC. For example, the EBC may include at least one of $TiO_2$, $Ta_2O_5$, $HfSiO_4$, an alkali metal oxide, or an alkali earth metal oxide. The additive may be added to the EBC to modify one or more desired properties of the EBC. For example, the additive components may increase or decrease the reaction rate of the EBC with CMAS, may modify the viscosity of the reaction product from the reaction of CMAS and the EBC, may increase adhesion of the EBC to substrate 24, may increase or decrease the chemical stability of the EBC, or the like.

Regardless of its composition, an EBC may be deposited with a substantially dense microstructure. As used herein, a substantially dense microstructure may include less than about 5 volume percent pores.

In some examples, coating 28 may include a TBC, which may provide thermal protection to substrate 24. The TBC may include stabilized zirconia, stabilized hafnia, or combinations thereof. The stabilizer may include a rare earth element or oxide.

In some examples, the TBC include zirconia and/or hafnia stabilized with multiple rare earth elements or multiple rare earth oxides. For example, the TBC may include zirconia and/or hafnia stabilized with a primary dopant, a first co-dopant, and a second co-dopant. Including multiple dopants, preferably of different ionic radii, may decrease the thermal conductivity of the TBC compared to a TBC that includes a single stabilizing element or compound. In some examples, by selecting the dopants appropriately, the TBC also may be more resistant to reaction with CMAS.

In some examples, the primary dopant may include ytterbia or consist of ytterbia. The TBC may include between about 2 mol. % and about 40 mol. % of the primary dopant, such as between about 2 mol. % and 20 mol. %, or between about 2 mol. % and 10 mol. % of the primary dopant. The primary dopant may be present in an amount that is greater than either of the first or second co-dopants, and may be present in an amount greater than the total amount of the first and second co-dopants.

The first co-dopant may include or consist of samaria. The TBC may include between about 0.1 mol. % and about 20 mol. % of the first co-dopant, such as between about 0.5 mol. % and 10 mol. %, or between about 0.5 mol. % and 5 mol. % of the first co-dopant.

The second co-dopant may include or consist of lutetia ($Lu_2O_3$), scandia ($Sc_2O_3$), ceria ($CeO_2$), gadolinia ($Gd_2O_3$), neodymia ($Nd_2O_3$), europia ($Eu_2O_3$), and combinations thereof. The TBC may include between about 0.1 mol. % and about 20 mol. % of the second co-dopant, such as between about 0.5 mol. % and 10 mol. %, or between about 0.5 mol. % and 5 mol. % of the second co-dopant.

In other examples, the TBC may include zirconia and/or hafnia stabilized with yttria and two rare earth oxides. For example, the TBC may include between about 3.7 wt. % and about 4.5 wt. % yttria, between about 7.3 wt. % and about 9.0 wt. % erbia ($Er_2O_3$), between about 1.3 wt. % and about 1.8 wt. % gadolinia ($Gd_2O_3$), and a balance zirconia and/or hafnia (e.g., between about 84.7 wt. % and about 87.7 wt. % zirconia and/or hafnia).

Regardless of its composition, the TBC may be deposited with a relatively porous microstructure, such as a columnar microstructure.

In some examples, coating 28 may include a CMAS-resistant layer. The CMAS-resistant layer may include a rare earth zirconate or rare earth hafnate, such as gadolinium zirconate (GZO). The rare earth zirconate may include pyrochlore ($RE_2Zr_2O_7$; where RE is a rare earth element), delta-phase ($RE_4Zr_3O_{12}$; where RE is a rare earth element), or the like. Regardless of its composition, a CMAS-resistant layer may be deposited with a substantially dense microstructure. As used herein, a substantially dense microstructure may include less than about 5 volume percent pores.

Additionally, or alternatively, coating 28 may include an abradable layer. The abradable layer may include a thermal barrier coating composition, an environmental barrier coating composition, or the like. The abradable layer may be porous. Porosity of the abradable layer may reduce a thermal conductivity of the abradable layer and/or may affect the abradability of the abradable layer. In some examples, the abradable layer includes porosity between about 10 vol. % and about 50 vol. %. In other examples, the abradable layer includes porosity between about 15 vol. % and about 35 vol. %, or about 20 vol. %. Porosity of the abradable layer is defined herein as a volume of pores or cracks in the abradable layer divided by a total volume of the abradable layer (including both the volume of material in the abradable layer and the volume of pores/cracks in the abradable layer).

In some examples, computing device 12 may be configured to control relative movement of thermal spray device 14 and/or stage 20 to control where thermal spray device 14 delivers suspension 32. For example, stage 20 may be movable relative to thermal spray device 14, thermal spray device 14 may be movable relative to stage 20, or both. In some implementations, stage 20 may be translatable and/or rotatable along at least one axis to position substrate 24 relative to thermal spray device 14. For instance, stage 20 may be translatable along the z-axis shown in FIG. 1 relative to thermal spray device 14.

Similarly, thermal spray device 14 may be translatable and/or rotatable along at least one axis to position thermal spray device 14 relative to stage 18. For example, thermal spray device 14 may be translatable in the x-y plane shown in FIG. 1, and/or may be rotatable in one or more rotational directions. Thermal spray device 14 may be translated using any suitable type of positioning mechanism, including, for example, linear motors, stepper motors, or the like. In other examples, thermal spray device 14 may be a hand-held spray device controlled by a human operator.

In implementations in which computing device 12 controls position of thermal spray device 14 and/or stage 18, computing device 12 may be configured control movement and positioning of thermal spray device 14 relative to stage 20, and vice versa, to control the locations at which coating 28 is formed. Computing device 12 may be configured to control movement of thermal spray device 14, stage 20, or both, based on a computer aided manufacturing or computer aided design (CAM/CAD) file. For example, computing device 12 may be configured to control thermal spray device 14 to trace a pattern to form a first layer of coating 28 on surface 26. Computing device 12 may be configured to control thermal spray device 14 or stage 20 to move substrate 24 away from thermal spray device 14, then control thermal spray device 14 to trace a second pattern to form a second layer of coating 28 on the first layer. Computing device 12 may be configured to control stage 20 and/or thermal spray device 14 in this manner to result in a plurality of layers. Together, the plurality of layers defines a coating 28.

Computing device 12 also may be configured to control suspension delivery device 16 to deliver suspension 32 with a desired composition of liquid carrier to plume 32. Examples of suspension delivery device 16 are shown in FIGS. 2A-2C and example techniques for forming suspension 32 with a desired composition will be described with reference to FIGS. 2A-2C.

Figure 2A:
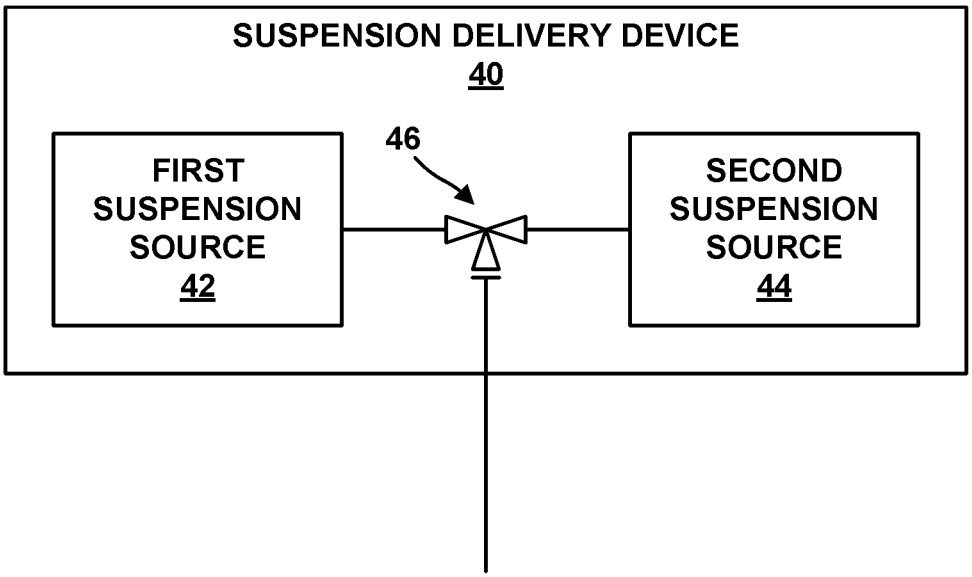
FIGS. 2A-2C are conceptual and schematic diagrams illustrating example suspension delivery devices, in accordance with examples of the disclosure.
Figure 2B:
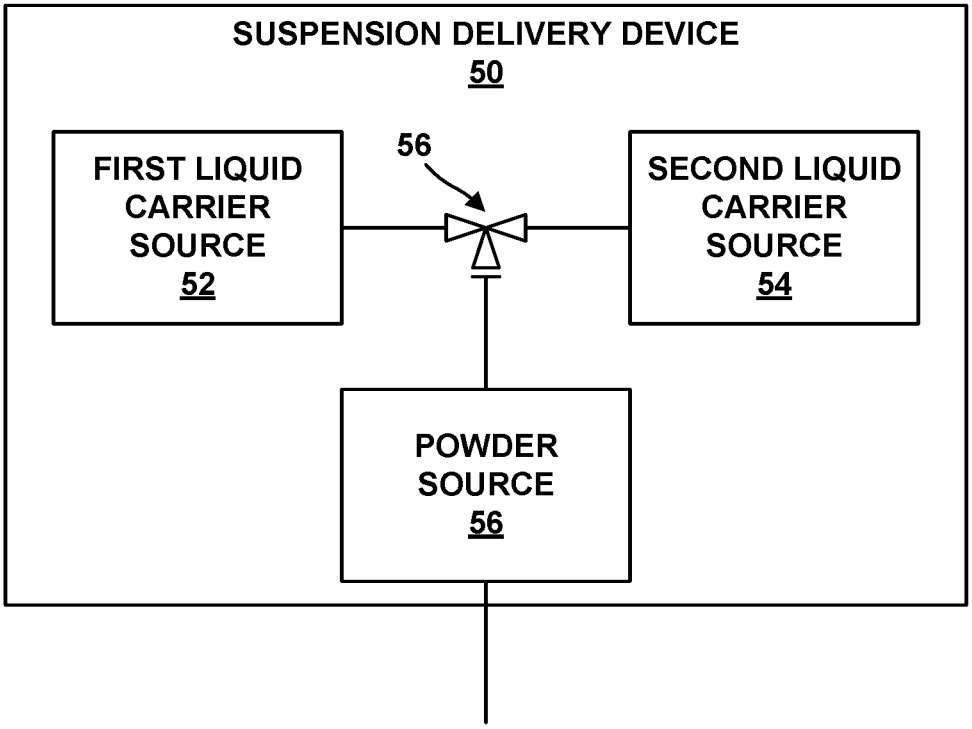
Figure 2C:
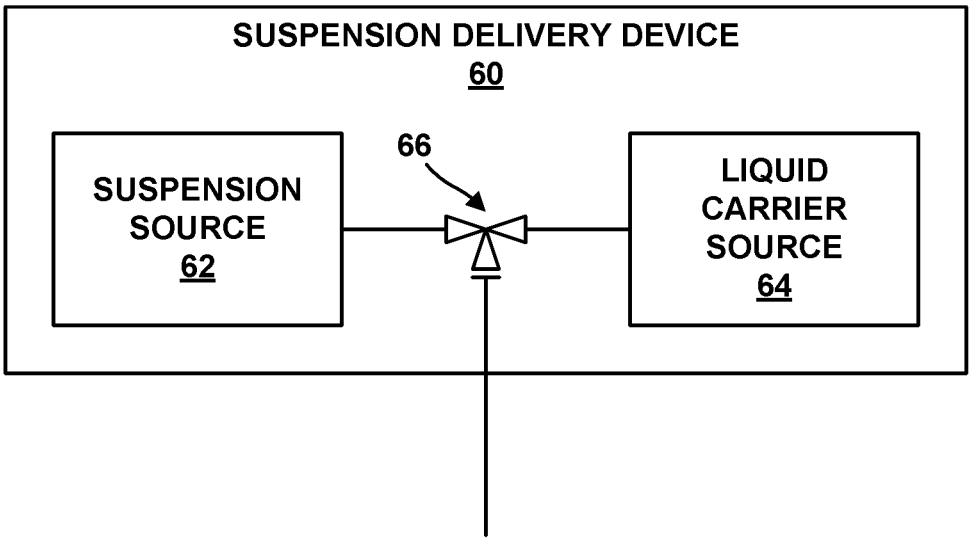

FIG. 2A illustrates an example suspension delivery device 40 that includes a first suspension source 42 and a second suspension source 44. Additionally, suspension delivery device 40 optionally includes a three-way valve 46. First suspension source 42 contains a first suspension. The first suspension includes a first liquid carrier and a plurality of particles suspended in the liquid carrier. Second suspension source 44 contains a second suspension. The second suspension includes a second liquid carrier and a plurality of particles suspended in the liquid carrier. The particles in the first and second suspensions may be the same, and the first and second liquid carriers are different.

The particles include a composition that forms coating 28 (FIG. 1). For example, the particles may include a TBC composition, an EBC composition, an abradable coating composition, a bond coat composition, or the like. In some examples, the particles may include a relatively small average or nominal diameter. For example, the particles may have an average or nominal diameter of less than about 10 microns, such as less than about 1.0 microns, or between about 0.5 microns and about 1.0 microns. Such relatively small particles may not be suitable for many thermal spraying processes, but are usable in suspension thermal spraying processes (e.g., suspension plasma spraying). In some examples, the particles in first suspension source 42 and the particles in second suspension source 44 have different average particle sizes or different particle size distributions. In other examples, the particles in first suspension source 42 and the particles in second suspension source 44 may be substantially similar.

As described above, the first and second liquid carriers may be selected to have different surface tensions. For example, the first liquid carrier may have a lower surface tension than the second liquid carrier. As an example, the first liquid carrier may include an alcohol and the second liquid carrier may include water. Surface tension of the liquid carrier in the suspension may affect how the suspension fragments into droplets when impinging on plume 30 (FIG. 1). For example, when the liquid carrier has a higher surface tension, the suspension may fragment into relatively larger droplets than when the liquid carrier has a lower surface tension. In this way, by controlling the relative concentration of the first and second liquid carriers in the suspension, the size of droplets into which the suspension fragments upon impinging on plume 30 may be affected.

Computing device 12 may be configured to control suspension delivery device 40 to form a suspension with a selected ratio of first suspension from first suspension source 42 and a second suspension from second suspension source 44. For example, computing device 12 may control three-way valve 46, or a set of one-way or two-way valves to control the ratio of flow of the first suspension and the second suspension to form the suspension delivered to thermal spray device 14. Alternatively, or additionally, suspension delivery device 40 may include one or more pumps that control flow of the first suspension from first suspension source 42 and second suspension from second suspension source 44. For instance, flow out of each of first suspension source 42 and second suspension source 44 may be controlled by a corresponding pump.

FIG. 2B illustrates another example suspension delivery device 50. Suspension delivery device 50 includes a first suspension source 52, a second suspension source 54, and a powder source 56. Additionally, suspension delivery device 50 optionally includes a three-way valve 56. First liquid carrier source 52 contains a first liquid carrier. Second liquid carrier source 54 contains a second liquid carrier. Powder source 56 includes a powder including a plurality of particles.

The particles include a composition that forms coating 28 (FIG. 1). For example, the particles may include a TBC composition, an EBC composition, an abradable coating composition, a bond coat composition, or the like. In some examples, the particles may be similar or substantially the same as those described above.

As described above, the first and second liquid carriers may be selected to have different surface tensions. For example, the first liquid carrier may have a lower surface tension than the second liquid carrier.

Computing device 12 may be configured to control suspension delivery device 50 to form a suspension with a selected ratio of a first liquid carrier from first liquid carrier source 52 and a second liquid carrier from second liquid carrier source 54. For example, computing device 12 may control three-way valve 56, or a set of one-way or two-way valves to control the ratio of flow of the first liquid carrier and the second liquid carrier to form the mixture delivered to powder source 56, followed by thermal spray device 14. Alternatively, or additionally, suspension delivery device 50 may include one or more pumps that control flow of the first liquid carrier from first liquid carrier source 52 and second liquid carrier from second liquid carrier source 54. For instance, flow out of each of first liquid carrier source 52 and second liquid carrier source 54 may be controlled by a corresponding pump. The powder may be suspended in the liquid carrier mixture and delivered to thermal spray device 14.

FIG. 2C illustrates another example suspension delivery device 60. Suspension delivery device 60 includes a suspension source 62 and a liquid carrier source 64. Additionally, suspension delivery device 60 optionally includes a three-way valve 66. Suspension source 62 contains suspension including a first liquid carrier and a plurality of particles suspended in the first liquid carrier. Liquid carrier source 64 contains a second liquid carrier. The first and second liquid carriers are different.

The particles include a composition that forms coating 28 (FIG. 1). For example, the particles may include a TBC composition, an EBC composition, an abradable coating composition, a bond coat composition, or the like. In some examples, the particles may be similar or substantially the same as those described above.

As described above, the first and second liquid carriers may be selected to have different surface tensions. For example, the first liquid carrier may have a lower surface tension than the second liquid carrier.

Computing device 12 may be configured to control suspension delivery device 60 to form a suspension with a selected ratio of a first liquid carrier from suspension source 62 and a second liquid carrier from liquid carrier source 64. For example, computing device 12 may control three-way valve 66, or a set of one-way or two-way valves to control the ratio of flow of the first liquid carrier and the second liquid carrier to form the mixture delivered to thermal spray device 14. Alternatively, or additionally, suspension delivery device 60 may include one or more pumps that control flow of the first liquid carrier from suspension source 62 and second liquid carrier from liquid carrier source 64. For instance, flow out of each of suspension source 62 and liquid carrier source 64 may be controlled using a corresponding pump. By controlling the flow from suspension source 62 and liquid carrier source 64, the ratio of first liquid carrier and second liquid carrier may be controlled.

Returning to FIG. 1, by controlling the relative ratio (or concentration) of the first and second liquid carriers in the suspension delivered to thermal spray device 14, the size of droplets into when entrained in plume 30 which suspension 32 fragments may be affected. The size of droplets into which suspension 32 fragments may affect the microstructure of the deposited coating 28. For example, a suspension 32 with lower surface tension, which breaks into relatively smaller droplets, may form a coating 28 having a columnar microstructure. While not wishing to be bound by theory, it is currently believed that this occurs because the relatively smaller droplets are carried across surface 26 of substrate 24 on which coating 28 is being formed to a greater extent than relatively larger droplets. As the relatively smaller droplets are carried across surface 26, they may impact surface asperities (e.g., high points on the surface due to surface roughness) and the particles may adhere to surface 26. This begins formation of a column, on which subsequent droplets may impact and deposit further material (particles) on the nascent column, eventually forming a column. A similar process may occur across surface 26 of substrate 24 to result in a columnar coating.

In contrast, a suspension with higher surface tension, which breaks into relatively larger droplets, may form a coating 28 having a substantially dense microstructure. While not wishing to be bound by theory, it is currently believed that this occurs because the relatively larger droplets are not as easily carried across surface 26 of substrate 24 on which coating 28 is being formed as the relatively smaller droplets. As a result, the relatively larger droplets impact substrate 24 more directly (e.g., at the angle of the plume with respect to the substrate) and the particles adhere to substrate 24 upon impact. A similar process may occur across surface 26 of substrate 24 as thermal spray device 14 is translated across surface 26 to result in a substantially dense coating.

A suspension with an intermediate surface tension (e.g., between the lower surface tension and the higher surface tension) may fracture into intermediately sized droplets, and may be used to deposit a coating 28 with intermediate porosity. As such, by controlling relative amounts of two liquid carriers in suspension 32, the resulting microstructure of coating 28 may be controlled along a continuum between being substantially dense (e.g., if suspension 32 includes substantially only the liquid carrier with the higher surface tension) and being columnar (e.g., if suspension 32 includes substantially only the liquid carrier with the lower surface tension). As the composition of the liquid carrier in suspension 32 may be controlled substantially in real-time by computing device 12 using, e.g., the three-way valve of FIGS. 2A-2C, pumps, or both, changes between microstructure of coating 28 may be made relatively easily, without switching between batches of different suspensions. This may enable formation of a coating 28 with density (or porosity) gradients, which may allow tailoring of properties of coating 28, e.g., between lower modulus (higher porosity) and hermeticity (lower porosity). The density gradient may be formed in the direction substantially normal to surface 26 or in the direction parallel to surface 26.

Figure 3A:
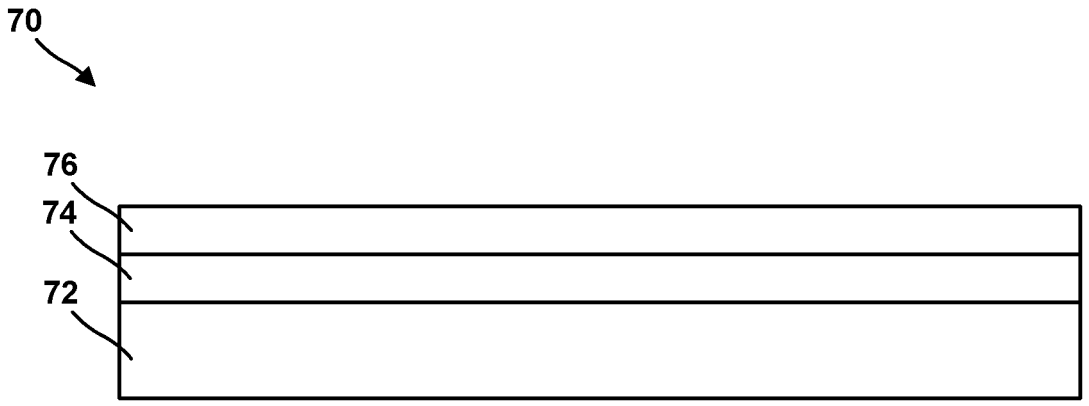
FIGS. 3A and 3B are conceptual diagrams illustrating example articles including substrates and coatings including different regions.
Figure 3B:
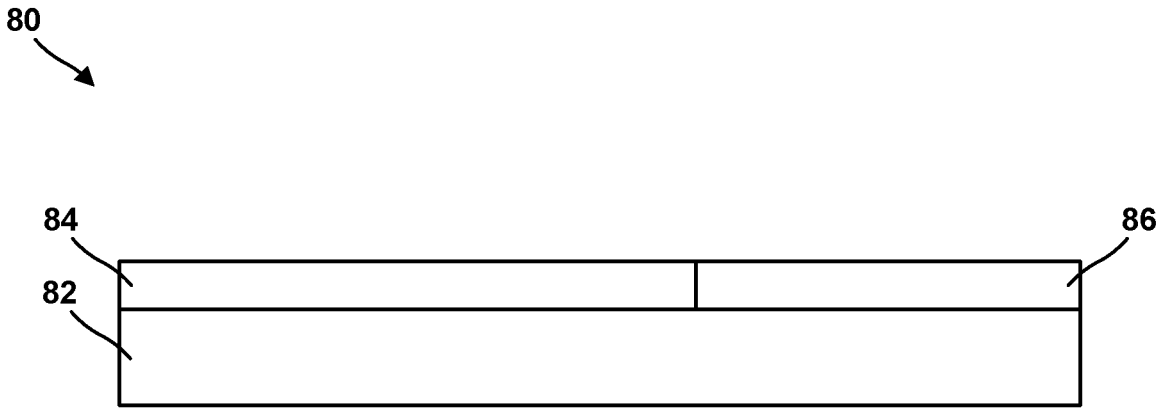

In some examples, the resulting coating may include a plurality of regions. FIGS. 3A and 3B illustrate examples in which a coating includes a plurality of regions. For instance, FIG. 3A illustrates an article 70 that includes a substrate 72, and a coating that includes a first layer 74 on substrate 72 and a second layer 76 on first layer 74. Substrate 72 may be an example of substrate 24 of FIG. 1. Each of first layer 74 and second layer 76 may have a selected coating chemistry. In some examples, the coating chemistry may be the same. In other examples, the coating chemistry may be different. The coating chemistries may include, for example, a bond coat chemistry, a thermal barrier coating chemistry, an environmental barrier coating chemistry, or an abradable coating chemistry.

First layer 74 and second layer 76 may have different microstructures. For example, one of first layer 74 or second layer 76 may have a relatively porous microstructure (e.g., including columnar, porous, or the like) and the other of first layer 74 or second layer 76 may have a relatively dense microstructure, a different type of porous microstructure, or a porous microstructure with a different level of porosity. As one example, first layer 74 may include an EBC coating chemistry and relatively dense microstructure and second layer 76 may include an abradable coating chemistry and relatively porous microstructure. As another example, first layer 74 may include a relatively porous (e.g., columnar) TBC coating chemistry and second layer 76 may include a relatively dense CMAS-resistant coating chemistry, such as gadolinium zirconate (GZO). In some examples, second layer 76 may have a substantially dense microstructure. As used herein, a relatively dense microstructure may include less than about 5 volume percent voids and/or pores.

In some examples, first layer 74 may include a TBC coating chemistry and a columnar microstructure. The TBC coating chemistry may include zirconia and/or hafnia stabilized with at least two rare earth oxides. For example, the TBC coating chemistry may include zirconia and/or hafnia stabilized with a primary dopant, a first co-dopant, and a second co-dopant, as described with reference to FIG. 1. As another examples, the TBC coating chemistry may include T between about 3.7 wt. % and about 4.5 wt. % yttria, between about 7.3 wt. % and about 9.0 wt. % erbia ($Er_2O_3$), between about 1.3 wt. % and about 1.8 wt. % gadolinia ($Gd_2O_3$), and a balance zirconia and/or hafnia (e.g., between about 84.7 wt. % and about 87.7 wt. % zirconia and/or hafnia).

In some of these examples in which first layer 74 includes a columnar TBC coating composition, second layer 76 may include a substantially dense CMAS-resistant composition, such as a rare earth zirconate. In some implementations, the rare earth zirconate includes gadolinium zirconate (GZO). While not wishing to be bound by theory, gadolinium zirconate may react with alumina in CMAS to form apatite phases and leave a calcia and/or magnesia-rich silicate glass phase. Should the calcia and/or magnesia-rich silicate glass phase penetrate second layer 76, the rare earth oxides in first layer 74 (e.g., erbia, gadolinia, or the like) may react with the calcia and/or magnesia-rich silicate glass phase to form other solid phases. This may reduce further penetration of the calcia and/or magnesia-rich silicate glass phase through first layer 74, e.g., to an underlying bond coat or substrate. In this way, the combination of a first layer 74 including a columnar TBC coating composition and a second layer 76 including a rare earth zirconate may provide protection to the coating system and substrate from high temperatures and CMAS attack.

Additionally, or alternatively, during thermal cycling (e.g., from system in which the coating is used being taken from "off" to "on" and back), a second layer 76 with a substantially dense microstructure that is on a first layer 74 having a columnar microstructure may undergo cracking to form narrow substantially vertical segmentation above the columnar spaces within first layer 76. This may provide the benefit of stress relief during thermal cycling.

As another example, FIG. 3B illustrates an article 80 that includes a substrate 82, and a coating that includes a first region 84 on substrate 82 and a second region 86 on substrate 82 and adjacent to first region 84. Each of first region 84 and second region 86 may have a selected coating chemistry, like first and second layers 74 and 76. First region 84 and second region 86 may have different microstructures. For example, one of first region 84 or second region 86 may have a relatively porous microstructure (e.g., including columnar, porous, or the like) and the other of first region 84 or second region 86 may have a relatively dense microstructure, a different type of porous microstructure, or a porous microstructure with a different level of porosity. In this way, properties of different regions of coatings may be customized in a single suspension thermal spraying technique.

Figure 4:
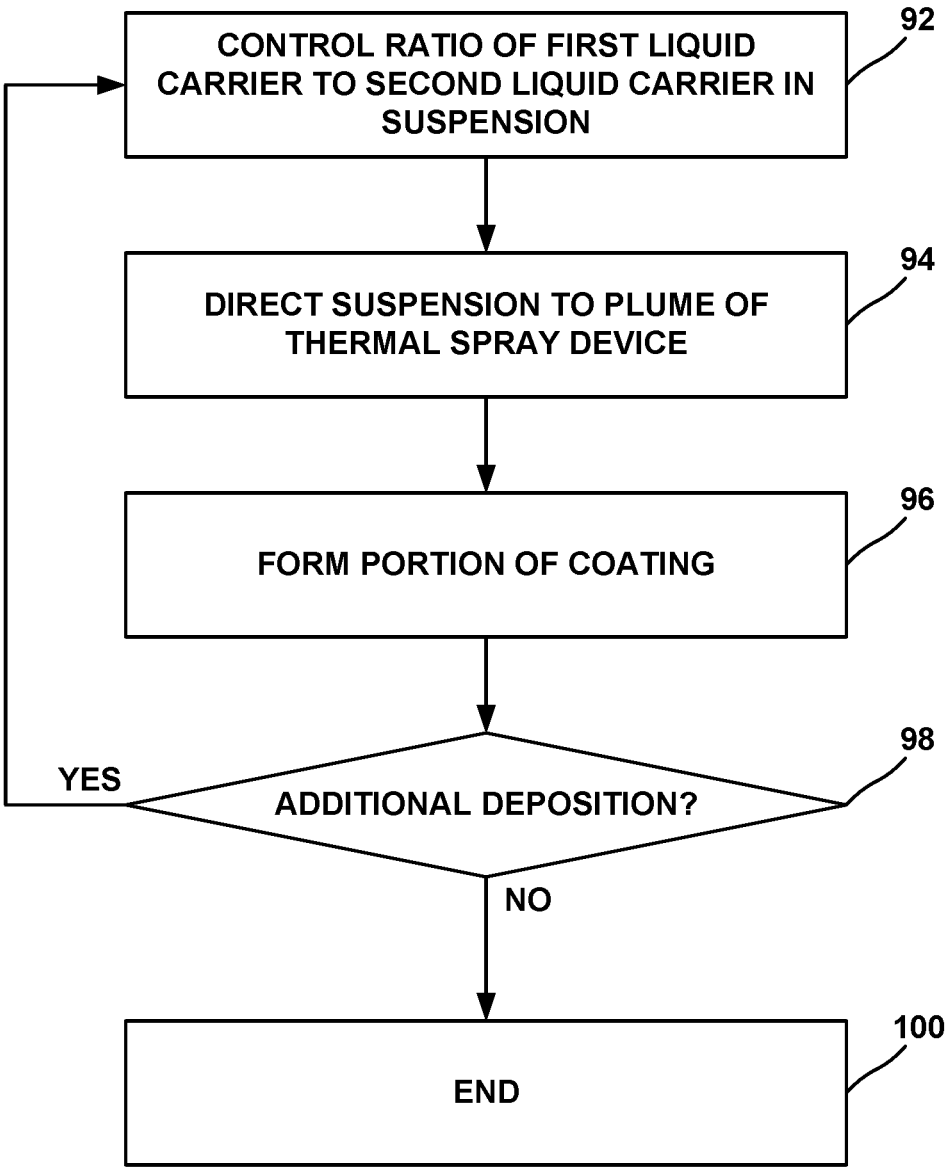
FIG. 4 is a flow diagram illustrating an example technique for depositing a coating using suspension plasma spraying, in accordance with an example of the disclosure.

FIG. 4 is a flow diagram illustrating an example technique for depositing a coating using suspension plasma spraying. The technique of FIG. 4 will be described with reference to FIG. 1, although a person having ordinary skill in the art will understand that the technique of FIG. 4 may be implemented using a different system.

The technique of FIG. 4 includes controlling a ratio of first liquid carrier to second liquid carrier in suspension 32 (92). For instance, computing device 12 may control suspension delivery device 16 to form suspension 32 with a selected ratio of first liquid carrier to second liquid carrier. As described with reference to FIGS. 2A-2C, computing device 12 may control one or more pumps, one or more valves, or the like, to control formation of suspension 32 with a selected ratio of first liquid carrier to second liquid carrier.

The technique of FIG. 4 then includes directing suspension 32 to plume 30 of thermal spray device 14 (94). For instance, computing device 12 may control suspension delivery device 16 to direct suspension 32 to plume 30.

The technique of FIG. 4 then includes forming a portion of coating 28 (96). For instance, the portion of coating 28 may be formed by particles of coating material in suspension 32 impacting surface 26 of substrate 24.

The technique of FIG. 4 then includes determining whether additional deposition of coating 28 is to occur (98). If additional deposition is to occur (the "YES" branch of FIG. 4), the technique returns to controlling the ratio of first liquid carrier to second liquid carrier in suspension 32 (92), followed by directing suspension 32 to plume 30 of thermal spray device 14 (94), and forming a portion of coating 28 (96). This process continues until no more portions of coating 28 are to be deposited (the "NO" branch of FIG. 4), at which time, the technique ends (100). In this way, real-time or near real-time control of the microstructure of coating 28 may be accomplished by controlling the ratio of the first liquid carrier to the second liquid carrier in suspension 32.

Clause 1: A method comprising: controlling a first ratio of a first liquid to a second liquid to form a first suspension comprising a powder and a first carrier liquid composition comprising at least one of the first liquid or the second liquid; directing the first suspension comprising the first carrier liquid and the powder to a plume of a thermal spray device; forming a first portion of a coating comprising the powder on a substrate from the first suspension; controlling a second ratio of the first liquid to the second liquid to form a second suspension comprising a second carrier liquid composition and the powder; directing the second suspension comprising the second carrier liquid composition and the powder to the plume of the thermal spray device; and forming a second portion of the coating comprising the powder on the substrate from the second suspension.

Clause 2: The method of clause 1, wherein the first ratio of the first liquid to the second liquid in the first carrier liquid composition is different from the second ratio of the first liquid to the second liquid in the second carrier liquid composition.

Clause 3: The method of clause 2, wherein the first carrier liquid composition is substantially free of the second liquid.

Clause 4: The method of clause 2 or 3, wherein the second carrier liquid composition is substantially free of the first liquid.

Clause 5: The method of clause 2, wherein the first carrier liquid composition comprises the first liquid and the second liquid.

Clause 6: The method of clause 2 or 5, where the second carrier liquid composition comprises the first liquid and the second liquid.

Clause 7: The method of any one of clauses 1 to 6, wherein controlling the ratio of the first liquid and the second liquid is completed in real time.

Clause 8: The method of any one of clauses 1 to 7, wherein the first liquid comprises water and the second liquid comprises an alcohol.

Clause 9: The method of any one of clauses 1 to 8, wherein the powder comprises an average particle size of less than 1 micrometer.

Clause 10: The method of any one of clauses 1 to 9, wherein the first portion is denser than the second portion.

Clause 11: The method of any one of clauses 1 to 9, wherein the second portion is denser than the first portion.

Clause 12: The method of any one of clauses 1 to 11, wherein the first portion comprises a first layer and the second portion comprises a second layer.

Clause 13: A system comprising: a suspension delivery assembly; a thermal spray device; and a computing device configured to: control the suspension delivery assembly to deliver a first suspension comprising a first carrier liquid composition and a powder to the thermal spray device, wherein the first carrier liquid composition comprises a first ratio of a first liquid to a second liquid, wherein the thermal spray device delivers the first suspension to a substrate to form a first portion of a coating comprising the powder on the substrate; and control the suspension delivery assembly to deliver a second suspension comprising a second carrier liquid composition and the powder to the thermal spray device, wherein the second carrier liquid composition comprises a second ratio of the first liquid to the second liquid, wherein the thermal spray device delivers the second suspension to the substrate to form a second portion of the coating comprising the powder on the substrate.

Clause 14: The system of clause 13, wherein the computing device is further configured to: control the thermal spray device to deliver the first suspension to the substrate to form the first portion of the coating comprising the powder on the substrate; and control the thermal spray device to deliver the second suspension to the substrate to form the second portion of the coating comprising the powder on the substrate.

Clause 15: The system of clause 13 or 14, wherein the first ratio of the first liquid to the second liquid in the first carrier liquid composition is different from the second ratio of the first liquid to the second liquid in the second carrier liquid composition.

Clause 16: The system of clause 15, wherein the first carrier liquid composition is substantially free of the second liquid.

Clause 17: The system of clause 15 or 16, wherein the second carrier liquid composition is substantially free of the first liquid.

Clause 18: The system of clause 15, wherein the first carrier liquid composition comprises the first liquid and the second liquid.

Clause 19: The system of clause 15 or 18, where the second carrier liquid composition comprises the first liquid and the second liquid.

Clause 20: The system of any one of clauses 13 to 19, wherein the computing device is configured to control the ratio of the first liquid and the second liquid in real time.

Clause 21: The system of any one of clauses 13 to 20, wherein the first liquid comprises water and the second liquid comprises an alcohol.

Clause 22: The system of any one of clauses 13 to 21, wherein the powder comprises an average particle size of less than 1 micrometer.

Clause 23: The system of any one of clauses 13 to 22, wherein the first portion is denser than the second portion.

Clause 24: The system of any one of clauses 13 to 22, wherein the second portion is denser than the first portion.

Clause 25: The system of any one of clauses 13 to 24, wherein the first portion comprises a first layer and the second portion comprises a second layer.

Clause 26: A computer readable storage medium comprising instructions, that, when executed by a computing device, cause the computing device to: control a suspension delivery assembly to deliver a first suspension comprising a first carrier liquid composition and a powder to a thermal spray device, wherein the first carrier liquid composition comprises a first ratio of a first liquid to a second liquid, wherein the thermal spray device delivers the first suspension to a substrate to form a first portion of a coating comprising the powder on the substrate; and control the suspension delivery assembly to deliver a second suspension comprising a second carrier liquid composition and the powder to the thermal spray device, wherein the second carrier liquid composition comprises a second ratio of the first liquid to the second liquid, wherein the thermal spray device delivers the second suspension to the substrate to form a second portion of the coating comprising the powder on the substrate.

Clause 27: The computer readable storage medium of clause 26, wherein the computing device is further configured to: control the thermal spray device to deliver the first suspension to the substrate to form the first portion of the coating comprising the powder on the substrate; and control the thermal spray device to deliver the second suspension to the substrate to form the second portion of the coating comprising the powder on the substrate.

Clause 28: The computer readable storage medium of clause 26 or 27, wherein the first ratio of the first liquid to the second liquid in the first carrier liquid composition is different from the second ratio of the first liquid to the second liquid in the second carrier liquid composition.

Clause 29: The computer readable storage medium of clause 28, wherein the first carrier liquid composition is substantially free of the second liquid.

Clause 30: The computer readable storage medium of clause 28 or 29, wherein the second carrier liquid composition is substantially free of the first liquid.

Clause 31: The computer readable storage medium of clause 28, wherein the first carrier liquid composition comprises the first liquid and the second liquid.

Clause 32: The computer readable storage medium of clause 28 or 31, where the second carrier liquid composition comprises the first liquid and the second liquid.

Clause 33: The computer readable storage medium of any one of clauses 26 to 32, wherein the computing device is configured to control the ratio of the first liquid and the second liquid in real time.

Clause 34: The computer readable storage medium of any one of clauses 26 to 33, wherein the first liquid comprises water and the second liquid comprises an alcohol.

Clause 35: The computer readable storage medium of any one of clauses 26 to 34, wherein the powder comprises an average particle size of less than 1 micrometer.

Clause 36: The computer readable storage medium of any one of clauses 26 to 35, wherein the first portion is denser than the second portion.

Clause 37: The computer readable storage medium of any one of clauses 26 to 35, wherein the second portion is denser than the first portion.

The techniques described in this disclosure may be implemented, at least in part, in hardware, software, firmware, or any combination thereof. For example, various aspects of the described techniques may be implemented within one or more processors, including one or more microprocessors, digital signal processors (DSPs), application specific integrated circuits (ASICs), field programmable gate arrays (FPGAs), or any other equivalent integrated or discrete logic circuitry, as well as any combinations of such components. The term "processor" or "processing circuitry" may generally refer to any of the foregoing logic circuitry, alone or in combination with other logic circuitry, or any other equivalent circuitry. A control unit including hardware may also perform one or more of the techniques of this disclosure.

Such hardware, software, and firmware may be implemented within the same device or within separate devices to support the various techniques described in this disclosure. In addition, any of the described units, modules or components may be implemented together or separately as discrete but interoperable logic devices. Depiction of different features as modules or units is intended to highlight different functional aspects and does not necessarily imply that such modules or units must be realized by separate hardware, firmware, or software components. Rather, functionality associated with one or more modules or units may be performed by separate hardware, firmware, or software components, or integrated within common or separate hardware, firmware, or software components.

The techniques described in this disclosure may also be embodied or encoded in a computer system-readable medium, such as a computer system-readable storage medium, containing instructions. Instructions embedded or encoded in a computer system-readable medium, including a computer system-readable storage medium, may cause one or more programmable processors, or other processors, to implement one or more of the techniques described herein, such as when instructions included or encoded in the computer system-readable medium are executed by the one or more processors. Computer system readable storage media may include random access memory (RAM), read only memory (ROM), programmable read only memory (PROM), erasable programmable read only memory (EPROM), electronically erasable programmable read only memory (EEPROM), flash memory, a hard disk, a compact disc ROM (CD-ROM), a floppy disk, a cassette, magnetic media, optical media, or other computer system readable media. In some examples, an article of manufacture may comprise one or more computer system-readable storage media.

Various examples have been described. These and other examples are within the scope of the following claims.

The invention claimed is:

1. A method comprising:

controlling a first ratio of a first liquid to a second liquid to form a first suspension comprising a powder and a first carrier liquid composition comprising at least one of the first liquid or the second liquid;

directing the first suspension comprising the first carrier liquid and the powder to a plume of a thermal spray device;

forming a first portion of a coating comprising the powder on a substrate from the first suspension;

controlling a second ratio of the first liquid to the second liquid to form a second suspension comprising a second carrier liquid composition and the powder, wherein the second carrier liquid composition includes the first liquid and the second liquid;

directing the second suspension comprising the second carrier liquid composition and the powder to the plume of the thermal spray device; and forming a second portion of the coating comprising the powder on the substrate from the second suspension, wherein the first ratio and the second ratio are controlled such that the first portion of the coating exhibits a first microstructure and the second portion exhibits a second microstructure different from the first microstructure.

2. The method of claim 1, wherein the first ratio of the first liquid to the second liquid in the first carrier liquid composition is different from the second ratio of the first liquid to the second liquid in the second carrier liquid composition.

3. The method of claim 2, wherein the first carrier liquid composition is substantially free of the second liquid.

4. The method of claim 2, wherein the first carrier liquid composition comprises the first liquid and the second liquid, and wherein the second carrier liquid composition comprises the first liquid and the second liquid in a different ratio than the first carrier liquid composition.

5. The method of claim 1, wherein controlling the first ratio and controlling the second ratio is performed in real time such that an adjustment from the first ratio to the second ratio occurs while directing the first suspension and the second suspension to the plume of the thermal spray device.

6. The method of claim 1, wherein a first density of the first portion is different than a second density of the second portion.

7. The method of claim 1, wherein the second portion is denser than the first portion.

8. The method of claim 1, wherein the first portion comprises a first layer and the second portion comprises a second layer.

9. The method of claim 1, wherein a second density of the second portion defined by the second microstructure is greater than a first density of the first portion defined by the first microstructure.

10. The method of claim 1, wherein one of the first microstructure and the second microstructure is a columnar microstructure, and wherein another of the first microstructure and the second microstructure is a dense microstructure having a density of less than about 5 volume percent.

11. The method of claim 1, wherein a surface tension of the first suspension is higher than a surface tension of the second suspension.

12. The method of claim 1, wherein a surface tension of the second suspension is higher than a surface tension of the first suspension.

13. The method of claim 12, wherein the first liquid includes alcohol and the second liquid includes water.

14. The method of claim 1, wherein directing the first suspension comprising the first carrier liquid and the powder to the plume of the thermal spray device and directing the second suspension comprising the second carrier liquid composition and the powder to the plume of the thermal spray device comprises continuously directing the first suspension and second suspension to the plume of the thermal spray device without switching between batches of different suspensions.

15. The method of claim 1, wherein controlling the first ratio and controlling the second ratio includes adjusting at least of a valve or a pump to change from the first ratio to the second ratio.

16. The method of claim 1, wherein the at least one of the valve or the pump includes a three way valve that receives the first liquid via a first inlet and the receives the second liquid via second inlet.

17. The method of claim 1, wherein the first ratio and the second ratio are controlled such that the first portion of the coating exhibits a first microstructure and the second portion exhibits a second microstructure different from the first microstructure by changing respective surface tensions of the first suspension and the second suspension.

18. The method of claim 1, wherein the powder includes gadolinium zirconate.

19. The method of claim 1, wherein the first suspension and the second suspension are directed out of the same outlet of a suspension delivery device to the plume of the thermal spray device.

20. A method comprising:

controlling a first ratio of a first liquid to a second liquid to form a first suspension comprising a powder and a first carrier liquid composition comprising at least one of the first liquid or the second liquid;

directing the first suspension comprising the first carrier liquid and the powder to a plume of a thermal spray device;

forming a first portion of a coating comprising the powder on a substrate from the first suspension;

controlling a second ratio of the first liquid to the second liquid to form a second suspension comprising a second carrier liquid composition and the powder, wherein the second carrier liquid composition includes the first liquid and the second liquid;

directing the second suspension comprising the second carrier liquid composition and the powder to the plume of the thermal spray device; and forming a second portion of the coating comprising the powder on the substrate from the second suspension, wherein the first ratio and the second ratio are controlled such that the first portion of the coating exhibits a first microstructure and the second portion exhibits a second microstructure different from the first microstructure, wherein the first ratio of the first liquid to the second liquid in the first carrier liquid composition is different from the second ratio of the first liquid to the second liquid in the second carrier liquid composition, wherein one of the first microstructure and the second microstructure is a columnar microstructure, and another of the first microstructure and the second microstructure is a dense microstructure having a density of less than about 5 volume percent, and wherein the first ratio and the second ratio are selected such that a surface tension of the second suspension is different than the first suspension.

* * * * *